US010363748B2

(12) United States Patent
Watanabe

(10) Patent No.: US 10,363,748 B2
(45) Date of Patent: Jul. 30, 2019

(54) LIQUID EJECTING APPARATUS

(71) Applicant: SEIKO EPSON CORPORATION, Tokyo (JP)

(72) Inventor: Yoshihiro Watanabe, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/840,840

(22) Filed: Dec. 13, 2017

(65) Prior Publication Data

US 2018/0170063 A1 Jun. 21, 2018

(30) Foreign Application Priority Data

Dec. 21, 2016 (JP) ..... 2016-248422

(51) Int. Cl.
*B41J 2/175* (2006.01)

(52) U.S. Cl.
CPC ..... *B41J 2/17506* (2013.01); *B41J 2/175* (2013.01); *B41J 2/17513* (2013.01); *B41J 2/17553* (2013.01)

(58) Field of Classification Search
None
See application file for complete search history.

(56) References Cited

U.S. PATENT DOCUMENTS 5,745,137 A * 4/1998 Scheffelin ..... B41J 2/175 347/50
2011/0050819 A1 3/2011 Bannai et al.

FOREIGN PATENT DOCUMENTS

| | | |
|---|---|---|
| JP | H07-304187 | 11/1995 |
| JP | 2010-241104 | 10/2010 |
| JP | 2014-046588 | 3/2014 |

* cited by examiner

*Primary Examiner* — Matthew Luu
*Assistant Examiner* — Tracey M McMillion
(74) *Attorney, Agent, or Firm* — Workman Nydegger

(57) ABSTRACT

A liquid ejecting apparatus includes a liquid ejecting head that ejects a liquid, and a liquid storage section that stores the liquid to be fed to the liquid ejecting head. The liquid storage section includes a storage tank of which at least part is provided with a flexible section having flexibility, a liquid feed port to feed the liquid to the liquid ejecting head, and a liquid filling inlet to refill the liquid. The liquid filling inlet is capable of opening and closing and capable of being sealed. Moreover, the storage tank has a volume that can be changed by the flexible section deforming.

4 Claims, 6 Drawing Sheets

LIQUID EJECTING APPARATUS

BACKGROUND

1. Technical Field

The present invention relates to a liquid ejecting apparatus that is capable of ejecting a liquid fed from a liquid storage section.

2. Related Art

An ink jet printer (referred to below as a "printer") that prints by ejecting ink stored in an ink cartridge onto a recording medium such as paper is an example of a liquid ejecting apparatus that is capable of ejecting a liquid. Generally, such printers are configured with a detachable ink cartridge inside a casing, and ink is replenished by replacing the ink cartridge with a new ink cartridge.

However, it is difficult to increase the size of ink cartridges, since the ink cartridges have to be of a size that can be housed inside the casing. When handling large printing volumes, for example, it is necessary to interrupt printing each time an ink cartridge runs out of ink in order to perform a replacement operation.

In order to reduce ink cartridge replacement operations, printers have been produced in which ink is replenished from the casing exterior by pouring ink contained in an ink pack or a refill container into a liquid storage section mounted to the casing (see, for example, JP-A-2014-46588).

However, in the printer described in JP-A-2014-46588, although a filling inlet of the liquid storage section is made airtight using a cover, the liquid surface of ink inside a liquid housing vessel is in contact with air, resulting in a gradual drop in the de-aeration level of the ink in the liquid housing vessel. This issue could be addressed by providing a de-aeration device inside the printer. However, de-aeration takes time, and the structure becomes more complex, increasing the cost of the apparatus.

SUMMARY

An advantage of some aspects of the invention is that a liquid ejecting apparatus enabling a liquid to be refilled without interrupting printing and that does not require de-aeration of the liquid inside a liquid storage section is provided with a simple configuration.

An aspect of the invention that addresses the above issue is a liquid ejecting apparatus including a liquid ejecting head that ejects a liquid, and a liquid storage section that stores the liquid to be fed to the liquid ejecting head. The liquid storage section includes a storage tank, a liquid feed port, and a liquid filling inlet. At least part of the storage tank is provided with a flexible section having flexibility. The liquid feed port feeds the liquid to the liquid ejecting head. The liquid filling inlet refills the liquid. The liquid filling inlet is capable of opening and closing and capable of being sealed, and the storage tank has a volume that can be changed by the flexible section deforming.

With a simple configuration, this aspect is capable of providing a liquid ejecting apparatus that enables the liquid to be refilled without interrupting printing and that does not require de-aeration of the liquid inside the liquid storage section.

The above liquid ejecting apparatus preferably further includes a pressing unit that presses the flexible section. This enables the liquid surface of the liquid to be made to rise by pressing the flexible section of the liquid storage section, thereby enabling any air that enters during liquid refilling to be removed easily.

Moreover, in the above liquid ejecting apparatus, the liquid filling inlet is preferably provided with a liquid filling assist member that assists with refilling of the liquid. The liquid filling assist member is preferably formed in a funnel shape including a first diameter opening larger than the liquid filling inlet and a second diameter opening of the same size as or smaller than the liquid filling inlet. This enables liquid to be refilled easily.

Moreover, in the above liquid ejecting apparatus, the liquid storage section preferably includes a rigid housing section, with the storage tank being provided inside the housing section. This enables the liquid inside the liquid storage section to be protected from shocks and the like, and enables an airtight state to be maintained, thus suppressing any drop in the de-aeration level of the liquid. There is therefore no need to perform de-aeration of the liquid inside the liquid storage section.

BRIEF DESCRIPTION OF THE DRAWINGS

The invention will be described with reference to the accompanying drawings, wherein like numbers reference like elements.

DESCRIPTION OF EXEMPLARY EMBODIMENTS

Explanation follows regarding an embodiment of the invention, with reference to the drawings. The following explanation describes one configuration of the invention; however, any appropriate modifications may be implemented within a range not departing from the spirit of the invention. Note that in the respective drawings, like numbers reference like elements, and explanation thereof may be omitted as appropriate. Moreover, X, Y, and Z indicate three mutually orthogonal spatial axes. In the present specification, directions along these axes are respectively referred to as a first direction X (X direction), a second direction Y (Y direction), and a third direction Z (Z direction), with the directions of the arrows in the respective drawings being positive (+) directions, and the opposite directions to the arrows being negative (−) directions. The X direction and the Y direction indicate in-plane directions of respective configuration elements, and the Z direction indicates a thickness direction or stacking direction of the respective configuration elements. Moreover, the configuration elements illustrated in the respective drawings, namely their shapes, sizes, relationships between their relative positions, and the like, may be exaggerated in order to assist explanation of the invention.

First Embodiment

Figure 1:
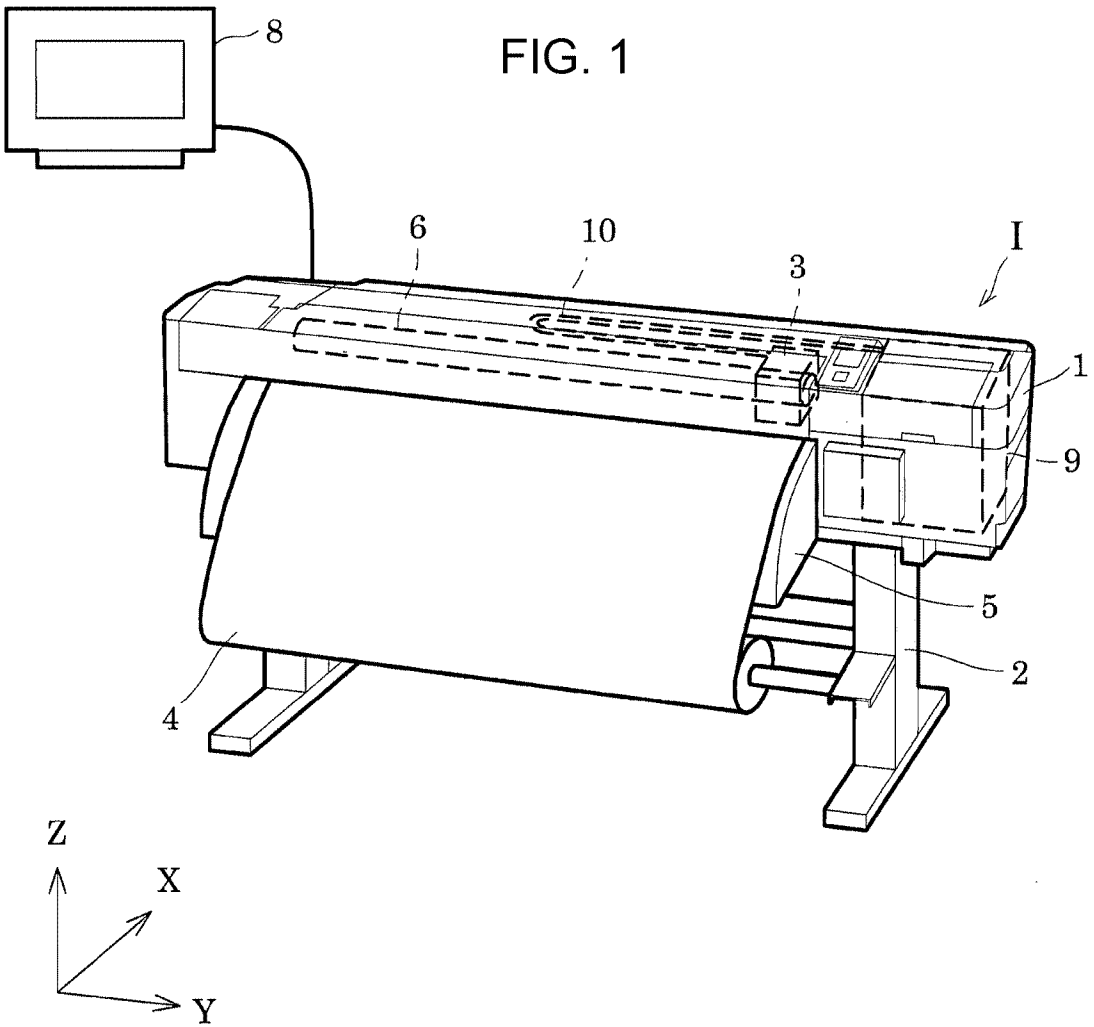
FIG. 1 is a perspective view illustrating a schematic configuration of an ink jet recording apparatus of a first embodiment.
Figure 2:
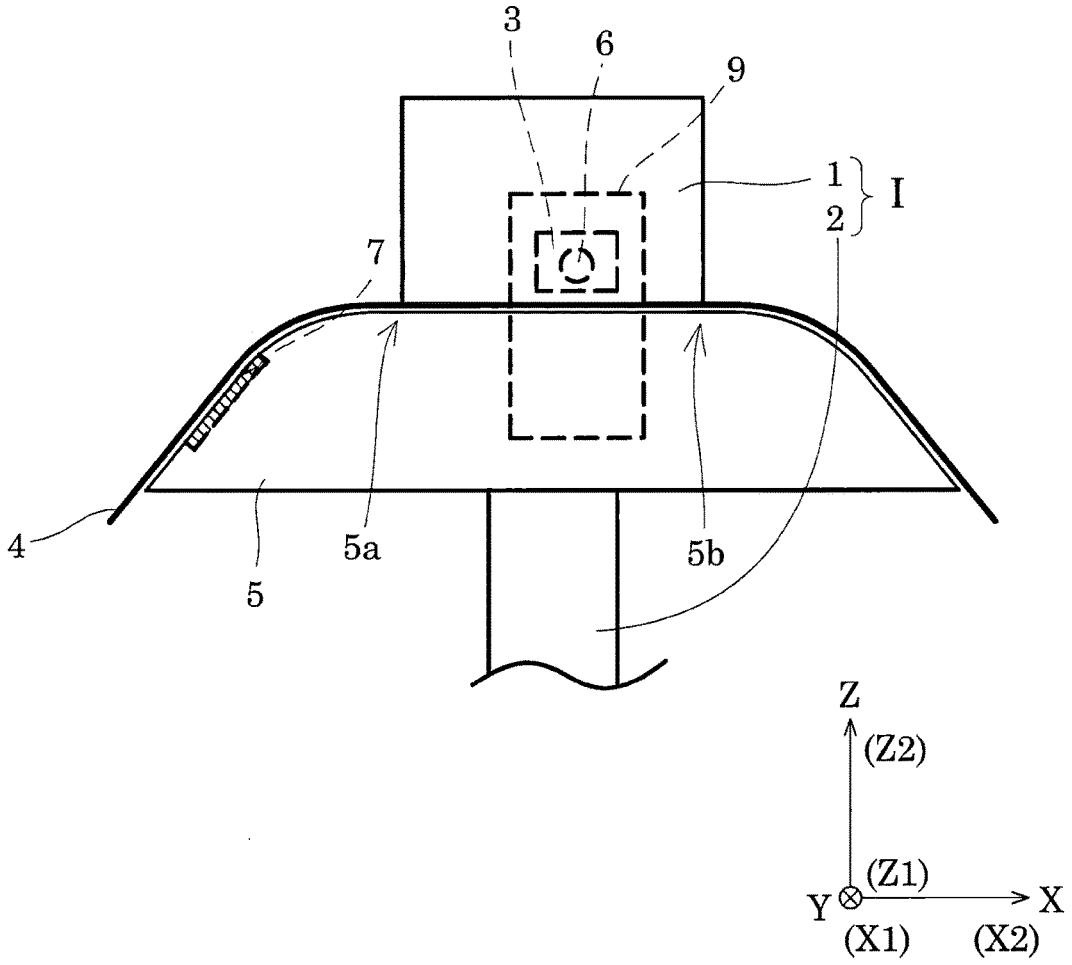
FIG. 2 is an enlarged view of relevant portions, illustrating part of FIG. 1 in lateral cross-section.

First, explanation follows regarding an ink jet recording apparatus, this being an example of a liquid ejecting apparatus, with reference to FIG. 1 and FIG. 2.

FIG. 1 is a perspective view illustrating a schematic configuration of an ink jet recording apparatus of a first embodiment. FIG. 2 is an enlarged view of relevant portions, illustrating part of FIG. 1 in lateral cross-section. As illustrated in these drawings, an ink jet recording apparatus (recording apparatus) I is a large-format printer including an apparatus main body 1 that has an inbuilt ink jet recording head (recording head) 3, this being a liquid ejecting head, and that is mounted on a stand 2 that supports a medium 4 wound into a roll. The recording apparatus I includes the apparatus main body 1, the stand 2 that supports the apparatus main body 1 and the medium 4, the recording head 3 that discharges ink droplets onto the medium 4 to perform specific printing, and a guide 5 that guides movement when the medium 4 is being transported.

In the recording apparatus I, a heater 7, this being a heating unit formed from an electrically conductive metal member, is provided embedded in the guide 5 upstream of the recording head 3 (on the X1 direction (negative (−) direction) side on the X axis). Note that the heater 7 heats the medium 4 prior to the medium 4 being printed on by the recording head 3. The guide 5 downstream of the recording head 3 (on the X2 direction (positive (+) direction) side on the X axis) may also be provided with an embedded heater similar to the heater 7. The heater downstream of the recording head 3 dries ink that has been printed onto the medium 4 by the recording head 3.

A control unit 8 is configured by an external personal computer (PC), and generates and outputs various control signals and the like to make respective sections of the recording apparatus I perform specific actions, notably drive signals to drive the recording head 3. This enables, for example, the drive signals to drive the recording head 3 in order to perform specific printing to be supplied remotely, without the control unit 8 being built into the apparatus main body 1. Configuration may also be made in which the control unit 8 is built into the apparatus main body 1.

The apparatus main body 1 includes a liquid storage section 9 that stores ink, serving as a liquid. The ink stored in the liquid storage section 9 is fed to the recording head 3 through a feed line 10 such as a tube. A pressurizing conveyance unit (not illustrated in the drawings) such as a pressurizing pump that pressurizes and conveys the ink in the liquid storage section 9 toward the recording head 3 is provided in the feed line 10 in the vicinity of the liquid storage section 9. Note that the pressurizing conveyance unit is not limited to a pressurizing pump, and may, for example, be a pressing unit that presses the exterior of the liquid storage section 9, or may be a suction pump or the like. Moreover, the pressurizing conveyance unit may employ a water head pressure difference arising as a result of adjusting the relative positions of the recording head 3 and the liquid storage section 9 in a vertical direction.

In the recording apparatus I, the medium 4 is moved and transported while being guided by the guide 5, and is fed into the apparatus main body 1 through an opening 5*a* on the upstream side of the apparatus main body 1. The medium 4 is then transported out through an opening 5*b* on the downstream side of the apparatus main body 1. Namely, the medium 4 is unwound from a rolled state supported on the stand 2, and is moved and transported into the apparatus main body 1 from the upstream side toward the downstream side. The medium 4 is subjected to specific printing by the recording head 3 while being transported, before being taken up onto a downstream reel (not illustrated in the drawings). The recording head 3 performs the specific printing while moving along a guide shaft 6 in directions (±Y direction) orthogonal to the transport direction (from the X1 direction toward the X2 direction along the X axis) of the medium 4.

Figure 3:
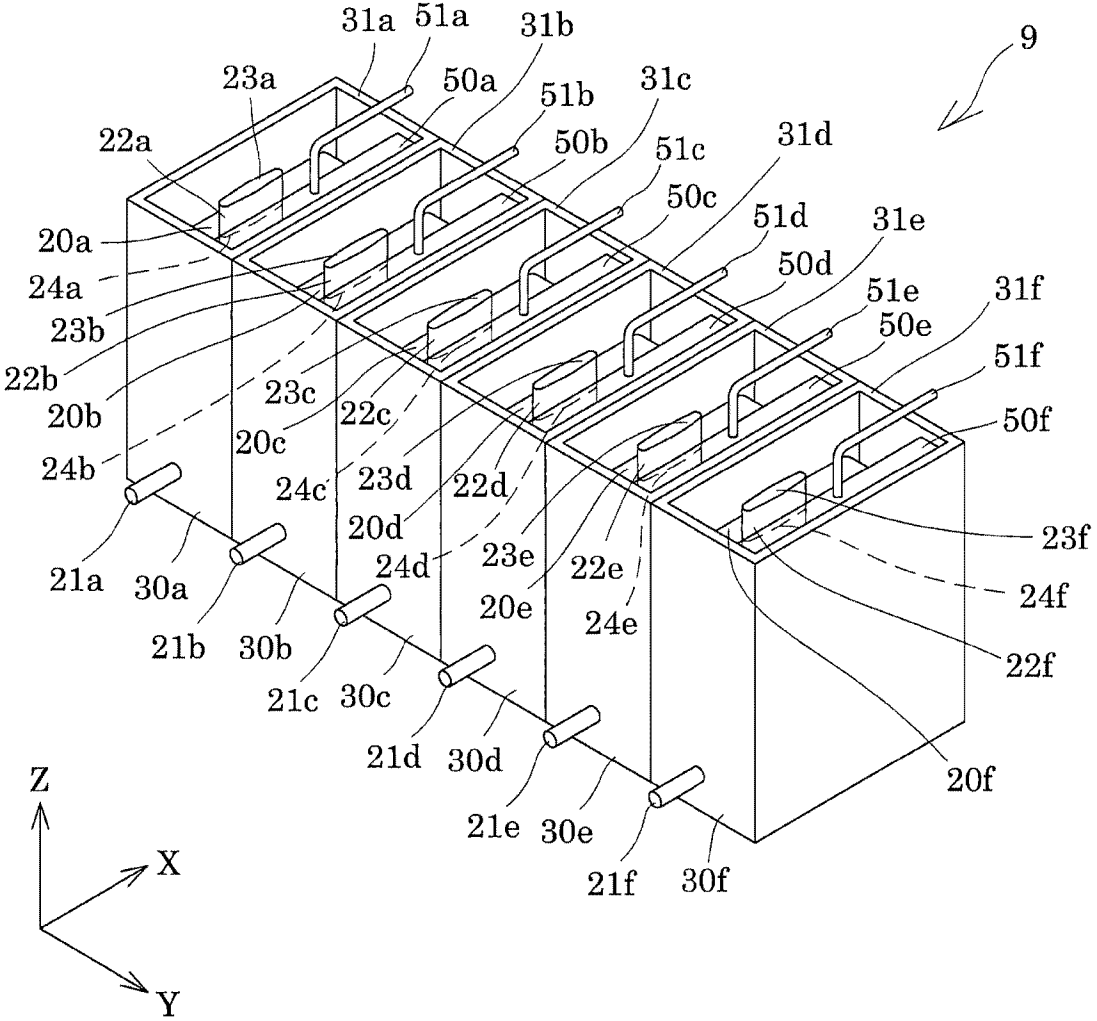
FIG. 3 is a perspective view illustrating a schematic configuration of a liquid storage section of the first embodiment.
Figure 4:
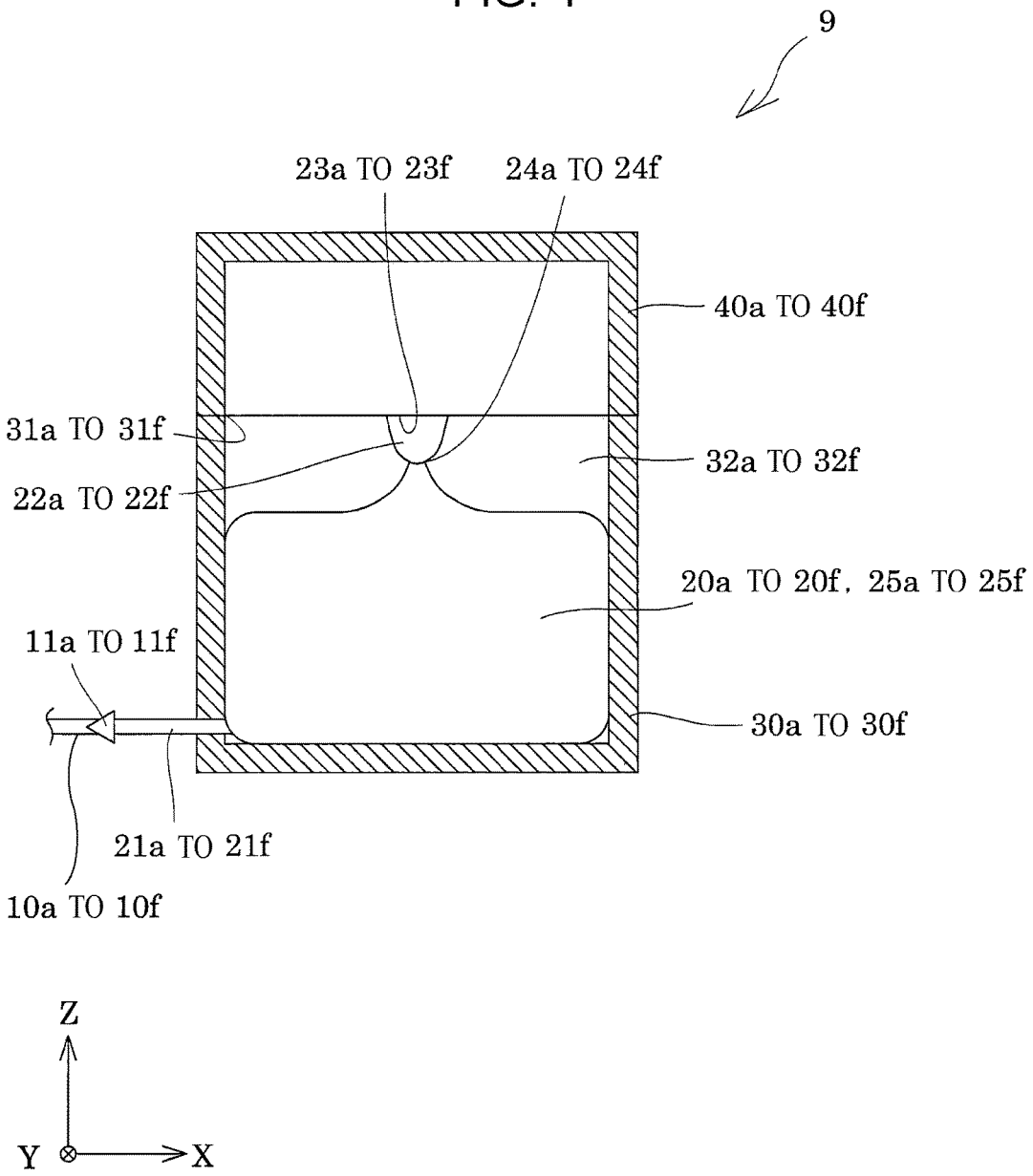
FIG. 4 is a diagram illustrating a schematic configuration of the interior of a liquid storage section of the first embodiment.
Figure 5:
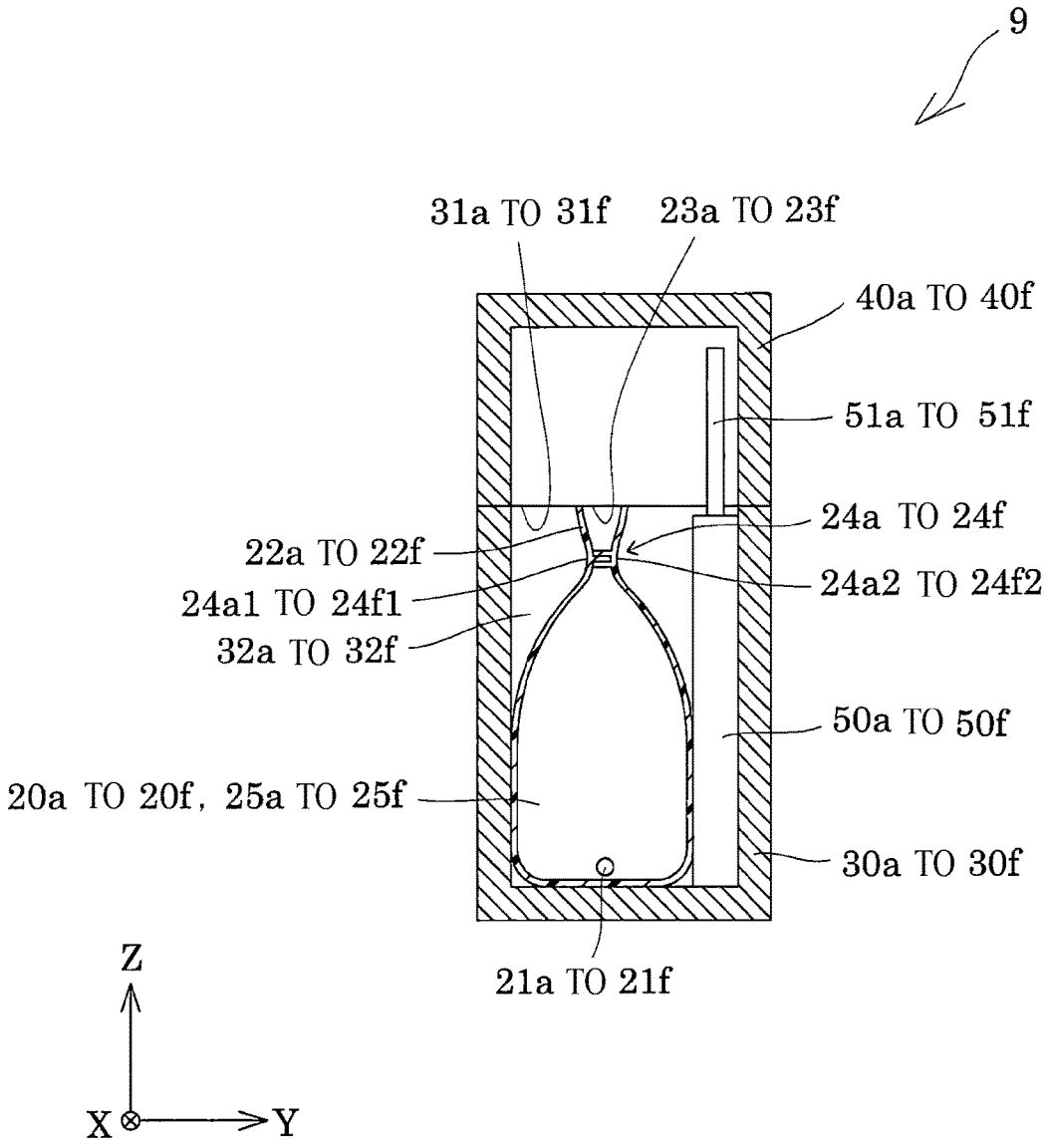
FIG. 5 is a diagram illustrating a schematic configuration of the interior of a liquid storage section of the first embodiment.

Next, explanation follows regarding the liquid storage section 9 mounted in the recording apparatus I, with reference to FIG. 3 to FIG. 5. FIG. 3 is a perspective view illustrating a schematic configuration of the liquid storage section of the first embodiment, and FIG. 4 and FIG. 5 are diagrams illustrating a schematic configuration of the interior of the liquid storage section of the first embodiment.

As illustrated in the drawings, the liquid storage section 9 includes plural (six in the present embodiment) storage tanks 20*a* to 20*f* that store ink to be fed to the recording head 3. The liquid storage section 9 also includes housing sections 30*a* to 30*f* that house the respective storage tanks 20*a* to 20*f*, covers 40*a* to 40*f* (see FIG. 4) that close off openings 31*a* to 31*f* in the respective housing sections 30*a* to 30*f*, and pressing units 50*a* to 50*f* that press the respective storage tanks 20*a* to 20*f*.

In the present embodiment, the liquid storage section 9 stores black ink and five colored inks in the storage tanks 20*a* to 20*f*. However, the types of ink stored may be selected as appropriate according to purpose. When so doing, the number of the storage tanks 20*a* to 20*f* and of the housing sections 30*a* to 30*f* may be determined according to the types of ink selected. Moreover, the housing sections 30*a* to 30*f* may be fixed together by a specific method, or may be provided individually inside the apparatus main body 1. The liquid storage section 9 may also be externally provided. As will be described in detail later, the recording apparatus I enables ink to be refilled even when in operation, and it makes no difference to the performance of the apparatus whether the liquid storage section 9 is built-in or externally provided.

Adjacent housing sections of the housing sections 30*a* to 30*f* are fixed together using a specific method, and are provided as a single housing section in the apparatus main body 1. The storage tanks 20*a* to 20*f* and the pressing units 50*a* to 50*f* are housed adjacent to one another in interiors 32*a* to 32*f* of the housing sections 30*a* to 30*f* fixed together in this manner. The shape, size, and the like of the housing sections 30*a* to 30*f* are not particularly limited, as long as the housing sections 30*a* to 30*f* are capable of housing the storage tanks 20*a* to 20*f* and the pressing units 50*a* to 50*f*, and may be modified appropriately depending on what they are to house. Moreover, the housing sections 30*a* to 30*f* are configured from a rigid material. This enables the ink inside the storage tanks 20*a* to 20*f* to be protected from shocks and the like, and enables a drop in the de-aeration level of the ink held in an airtight state to be suppressed. There is therefore no need to perform de-aeration of the ink in the storage tanks 20*a* to 20*f* in the recording apparatus I.

The shape, size, and the like of the covers 40*a* to 40*f* are not particularly limited, as long as the covers 40*a* to 40*f* are capable of closing off the openings 31*a* to 31*f* in the housing sections 30*a* to 30*f* and keeping the interiors thereof airtight. Appropriate modifications may be made according to the shapes, sizes, and the like of the openings 31*a* to 31*f*, the storage tanks 20*a* to 20*f*, and the pressing units 50*a* to 50*f*. The covers 40*a* to 40*f* are preferably formed from the same material as the housing sections 30*a* to 30*f*, and are, for example, configured from a rigid material. This thereby enables the ink inside the storage tanks 20*a* to 20*f* to be protected from shocks and the like.

When the recording apparatus I is in operation, in the liquid storage section 9, the storage tanks 20*a* to 20*f* that have been filled with de-aerated ink and made airtight are housed in the interiors 32*a* to 32*f* of the housing sections 30*a* to 30*f*. In this state, when the openings 31*a* to 31*f* of the housing sections 30*a* to 30*f* have been closed off using the covers 40*a* to 40*f*, an airtight seal is formed, preventing air from flowing in from the exterior. When the liquid storage section 9 has been made airtight in this manner, the recording apparatus I is capable of feeding ink to the recording head 3 through feed lines 10*a* to 10*f*, described later.

During ink refill, in the liquid storage section 9, the covers 40*a* to 40*f* are removed, thereby opening up the openings 31*a* to 31*f* of the housing sections 30*a* to 30*f* and the storage tanks 20*a* to 20*f* to the exterior. De-aerated ink is then poured into the storage tanks 20*a* to 20*f*. When the storage tanks 20*a* to 20*f* are opened to the exterior in this manner, sealing valves 11*a* to 11*f*, described later, are closed, such that there is no change in the feed pressure of the recording apparatus I. This enables the recording apparatus I to be refilled with ink even when in operation.

In the vicinity of bottom faces of the storage tanks 20*a* to 20*f*, front faces (−X direction side faces) of the storage tanks 20*a* to 20*f* are provided with tube shaped liquid feed ports 21*a* to 21*f* that feed ink to the recording head 3. The liquid feed ports 21*a* to 21*f* are partially exposed to the exterior of the housing sections 30*a* to 30*f*, enabling connection of the feed lines 10*a* to 10*f*. The liquid feed ports 21*a* to 21*f* are connected to the feed lines 10*a* to 10*f*, thereby enabling ink to be fed to the recording head 3. Note that in FIG. 1, the feed lines 10*a* to 10*f* are simplified and illustrated as a "feed line 10". Moreover, the sealing valves 11*a* to 11*f* are provided between the liquid feed ports 21*a* to 21*f* and the feed lines 10*a* to 10*f*, enabling the effect on the recording head 3 of any change in feed pressure to be reduced. Namely, due to closing the sealing valves 11*a* to 11*f*, there is no negative impact on the recording head 3 even if the feed pressure of the ink from the storage tanks 20*a* to 20*f* changes.

Flattened tube shaped liquid filling sections 22*a* to 22*f* are provided extending along the direction of the covers 40*a* to 40*f*, at upper faces (+Z direction side faces) of the storage tanks 20*a* to 20*f*. The liquid filling sections 22*a* to 22*f* are formed in tapered shapes, becoming gradually narrower in cross-sectional area on progression toward the bottom faces (−Z direction-side faces) of the storage tanks 20*a* to 20*f*. This facilitates the flow of ink into the storage tanks 20*a* to 20*f*. One end of each of the liquid filling sections 22*a* to 22*f* is in communication with the interior of the storage tanks 20*a* to 20*f*, and the other ends thereof are formed with liquid filling inlets 23*a* to 23*f* that are open to the exterior, and that enable de-aerated ink to be refilled.

The one ends of the liquid filling sections 22*a* to 22*f* are provided with interlocking portions (zip-lock mechanisms 24*a* to 24*f*) including male portions 24*a*1 to 24*f*1 and female portions 24*a*2 to 24*f*2, these being capable of interlocking with one another. The male portions 24*a*1 to 24*f*1 extend along one inner wall of each respective liquid filling section 22*a* to 22*f* following the liquid filling inlets 23*a* to 23*f*, and the female portions 24*a*2 to 24*f*2 extend along another inner wall forming of each respective liquid filling section 22*a* to 22*f* following the liquid filling inlets 23*a* to 23*f*. Each of the male portions 24*a*1 to 24*f*1 has a protruding cross-section profile, and each of the female portions 24*a*2 to 24*f*2 has a recessed cross-section profile. The male portions 24*a*1 to 24*f*1 and the female portions 24*a*2 to 24*f*2 are capable of interlocking with each other. Namely, the zip-lock mechanisms 24*a* to 24*f* are capable of opening, closing, and sealing the liquid storage section 9.

Specifically, during ink refill, the ink is refilled until the liquid surface of the ink inside the storage tanks 20*a* to 20*f* passes the zip-lock mechanisms 24*a* to 24*f*, and in this state, the male portions 24*a*1 to 24*f*1 and the female portions 24*a*2 to 24*f*2 of the zip-lock mechanisms 24*a* to 24*f* are interlocked, thereby sealing the liquid filling inlets 23*a* to 23*f*. This enables any air that enters the storage tanks 20*a* to 20*f* together with the ink to be removed. Any ink that has overflowed from the liquid filling inlets 23*a* to 23*f* is then wiped off, and the openings 31*a* to 31*f* of the housing sections 30*a* to 30*f* are closed off by the covers 40*a* to 40*f*, thereby enabling the ink to be retained in a state in which any drop in the de-aeration level is kept to a minimum.

The present embodiment is provided with the zip-lock mechanisms 24*a* to 24*f*. However, the structure thereof is not particularly limited as long as the liquid filling inlets 23*a* to 23*f* can be opened and closed in order to refill ink, and can be sealed so as to prevent ink leakage and make the interior of the storage tanks 20*a* to 20*f* airtight, thereby suppressing a drop in the de-aeration level of the ink. For example, the male portions 24*a*1 to 24*f*1 and the female portions 24*a*2 to 24*f*2 may be respectively provided to the opposite internal walls, or another mechanism, such as a clip mechanism that pinches the liquid filling sections 22*a* to 22*f* from both external wall sides to seal the liquid filling inlets 23*a* to 23*f*, may be employed.

The zip-lock mechanisms 24*a* to 24*f* are capable of being made airtight without allowing a drop in the de-aeration level of the ink. The zip-lock mechanisms 24*a* to 24*f* are preferably formed from a material having elasticity that enables deformation when subjected to external force, and having a rigidity that does not degrade when the male portions 24*a*1 to 24*f*1 and the female portions 24*a*2 to 24*f*2 are locked and released repeatedly. As described in detail later, the zip-lock mechanisms 24*a* to 24*f* are preferably configured by a transparent or translucent material that allows the liquid surface of the ink to be checked visually when the liquid filling inlets 23*a* to 23*f* have been sealed. It is sufficient that the liquid surface of the ink can be checked, and the zip-lock mechanisms 24*a* to 24*f* may be colorless, or may be colored as appropriate. Examples of such materials include polyester-based resins such as polyethylene terephthalate, polyolefin-based resins such as polyethylene, and polyamide-based resins such as nylon.

The storage tanks 20*a* to 20*f* are configured by flexible sections 25*a* to 25*f* that make the entire tanks flexible. The volume of the storage tanks 20*a* to 20*f* can be changed by deforming the flexible sections 25*a* to 25*f* by pressing the flexible sections 25*a* to 25*f* with the pressing units 50*a* to 50*f*. Namely, when the flexible sections 25*a* to 25*f* are pressed by the pressing units 50*a* to 50*f*, these sections are squashed and deformed in response, thus reducing the volume of the storage tanks 20*a* to 20*f*. The liquid surface of the ink inside the storage tanks 20*a* to 20*f* can thus be made to rise.

For example, during ink refill, in cases in which the liquid surface of the ink that has been poured in does not reach the zip-lock mechanisms 24*a* to 24*f*, the flexible sections 25*a* to 25*f* are pressed by the pressing units 50*a* to 50*f* to change and reduce the volume of the storage tanks 20*a* to 20*f* until the liquid surface of the ink in the storage tanks 20*a* to 20*f* passes the zip-lock mechanisms 24*a* to 24*f*. Accordingly, even if the amount of ink refilled is small, air remaining in the storage tanks 20*a* to 20*f* can easily be removed.

It is sufficient that the flexible sections 25*a* to 25*f* be provided to at least part of the storage tanks 20*a* to 20*f*, according to the installation conditions of the pressing units 50*a* to 50*f*. Namely, the volume of the storage tanks 20*a* to 20*f* can be changed by pressing as long as the flexible sections 25*a* to 25*f* are configured at least at side faces on the sides provided with the pressing units 50*a* to 50*f* (+Y direction sides). In the present embodiment, the flexible sections 25*a* to 25*f* can be made airtight without allowing a drop in the de-aeration level of the ink, and are formed using a material having both an elasticity capable of deforming when subjected to external force, and having a rigidity that does not degrade after repeated pressing by the pressing units 50*a* to 50*f*. Examples of such a material include polyester-based resins such as polyethylene terephthalate, polyolefin-based resins such as polyethylene, and polyamide-based resins such as nylon. Other layers may be provided on the surface of the flexible sections 25*a* to 25*f* as long as neither the elasticity nor the rigidity of the flexible sections 25*a* to 25*f* are compromised. For example, a metal foil layer configured by aluminum (Al) or the like may be formed on the surface of a polyester-based resin or the like, thus further suppressing a drop in the de-aeration level of the ink.

Note that in cases in which the storage tanks 20*a* to 20*f* are partially configured by the flexible sections 25*a* to 25*f*, the portions of the storage tanks 20*a* to 20*f* not configured by the flexible sections 25*a* to 25*f* may be formed from a material that can be made airtight so as not to allow a drop in the de-aeration level of the ink. Examples of such materials include thermoplastic resins such as polypropylene (PP). As long as airtightness is not compromised, a metal foil layer configured by aluminum (Al) or the like may be formed on the surface of the storage tanks 20*a* to 20*f*, thus further suppressing a drop in the de-aeration level of the ink.

Figure 6:
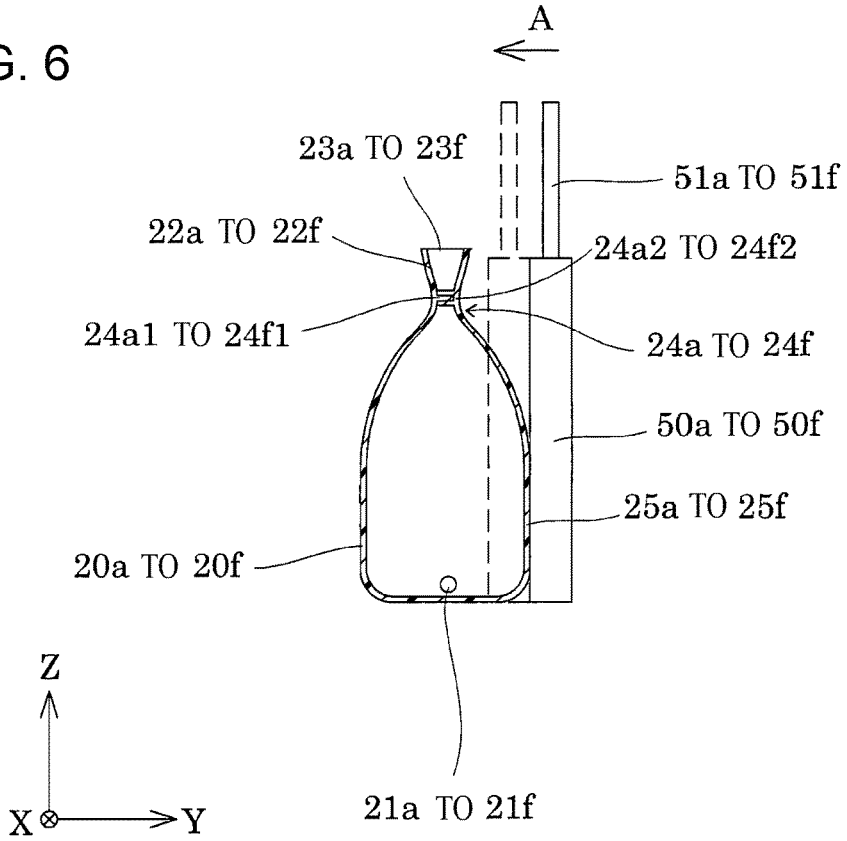
FIG. 6 is a diagram to explain a method for pressing a storage tank in the first embodiment.

FIG. 6 is a diagram to explain a method for pressing the storage tanks of the first embodiment. In this example, the flexible sections 25*a* to 25*f* are formed at the side faces of the respective storage tanks 20*a* to 20*f* on the sides (+Y direction sides) provided with the respective pressing units 50*a* to 50*f*. As illustrated in FIG. 6, the pressing units 50*a* to 50*f* are disposed at the side face of the storage tanks 20*a* to 20*f* on the side provided with the flexible sections 25*a* to 25*f*. The pressing units 50*a* to 50*f* are supported such that the pressing units 50*a* to 50*f* are capable of sliding in a direction intersecting the faces of the flexible sections 25*a* to 25*f*. Moreover, pressing rods 51*a* to 51*f* are provided to upper faces of the pressing units 50*a* to 50*f* on the side of the covers 40*a* to 40*f*. Each of the pressing rods 51*a* to 51*f* is bent in the vicinity of its center. In the present embodiment, the pressing rods 51*a* to 51*f* are configured so as to be capable of pressing the sides of the storage tanks 20*a* to 20*f*, thereby moving (sliding) the pressing units 50*a* to 50*f* toward the side of the storage tanks 20*a* to 20*f* (arrow A direction side), and thereby pressing the flexible sections 25*a* to 25*f*. Pressing mechanisms configured in this manner are also applied in the aforementioned example employing the storage tanks 20*a* to 20*f* in which the entire tanks are configured from the flexibly configured flexible sections 25*a* to 25*f* (see FIG. 3, etc.). Note that there is no limitation to the pressing mechanism described above as long as the flexible sections 25*a* to 25*f* can be pressed. For example, the pressing units 50*a* to 50*f* may be provided with a spring mechanism, or may employ a mechanism in which the pressing units 50*a* to 50*f* are moved by rotating the pressing rods 51*a* to 51*f*.

Next, explanation follows regarding an ink refill method of the liquid storage section 9, with reference to FIG. 3 to FIG. 6. As an example, explanation follows regarding a case in which the storage tank 20*a* is refilled with ink. First, after a specific method has been used to detect that the remaining ink amount in the storage tank 20*a* has reached a predetermined value or lower, de-aerated refill ink is prepared. Next, the cover 40*a* is removed to open the opening 31*a* of the housing section 30*a* to the exterior, and the check valve 11*a* is closed. Then, the interlocked zip-lock mechanism 24*a* of the storage tank 20*a* is released, thereby opening the liquid filling inlet 23*a* to the exterior. In this state, the refill ink is poured in through the liquid filling inlet 23*a* until the liquid surface of the ink inside the storage tank 20*a* passes the zip-lock mechanism 24*a*. In this state, the male portion 24*a*1 and the female portion 24*a*2 of the zip-lock mechanism 24*a* are interlocked with each other to seal the liquid filling inlet 23*a*. Any air that has entered the storage tank 20*a* during ink refill is thereby removed. Next, any ink that has overflowed from the liquid filling inlet 23*a* is wiped off to prevent contaminated ink from entering the storage tank 20*a* the next time ink is refilled. The opening 31*a* of the housing section 30*a* is then closed off by the cover 40*a* to maintain a state in which any drop in the de-aeration level inside the storage tank 20*a* is kept to a minimum. Any drop in the de-aeration level of the ink in the storage tanks 20*b* to 20*f* can also be kept to a minimum in a similar manner.

Note that since ink is refilled with the check valve 11*a* in a closed state, even when ink is poured in through the open liquid filling inlet 23*a* and the liquid surface inside the storage tank 20*a* changes, the feed pressure of ink to the recording head 3 does not change, and there is therefore no negative impact on the recording head 3. Accordingly, the recording apparatus I enables ink to be refilled without interrupting printing. Moreover, since the zip-lock mechanism 24*a* is interlocked to seal the liquid filling inlet 23*a* in a state in which the liquid surface of the refill ink poured into the storage tank 20*a* has passed the zip-lock mechanism 24*a*, any air that enters the storage tank 20*a* during ink refill can be removed easily. Accordingly, since the ink stored inside the storage tank 20*a* does not come into contact with air, a drop in the de-aeration level of the ink is suppressed, enabling a constant de-aeration level to be maintained, such that there is no need to perform de-aeration of the ink inside the liquid storage section 9 using a de-aeration device or the like. The storage tanks 20*b* to 20*f* similarly enable ink refill without interrupting printing, and without performing de-aeration of the ink.

When the amount of refill ink prepared is small, it is possible that the liquid surface of the poured-in ink might not reach the zip-lock mechanism 24*a*. In such cases, after refilling the ink, the flexible section 25*a* of the storage tank 20*a* is pressed using the pressing unit 50*a*. The flexible section 25*a* is squashed and deformed as a result, reducing the volume of the storage tank 20*a* such that the liquid surface of the ink rises. The flexible section 25*a* of the storage tank 20*a* is pressed by the pressing unit 50*a* until the liquid surface of the ink passes the zip-lock mechanism 24*a*, and in this state, the liquid filling inlet 23*a* is sealed by the zip-lock mechanism 24*a*, and any air that has entered the storage tank 20*a* is removed. When this is performed, as long as the check valve 11*a* is closed, there is no change in the feed pressure of ink to the recording head 3 and there is no negative impact on the recording head 3, even when the liquid filling inlet 23*a* is opened and ink is poured in, changing the liquid surface inside the storage tank 20*a*. Any air that enters the storage tank 20*a* during ink refill can accordingly be easily removed even in cases in which the amount of refill ink prepared is small. Accordingly, the ink stored in the storage tank 20*a* does not come into contact with air, enabling any drop in the de-aeration level to be suppressed. Moreover, since ink is refilled with the check valve 11*a* in a closed state, the recording apparatus I can be refilled with ink without interrupting printing. In a similar manner, in the storage tanks 20*b* to 20*f*, the recording apparatus I enables ink to be refilled without interrupting printing even in cases in which the amount of refill ink prepared is small.

Second Embodiment

Figure 7:
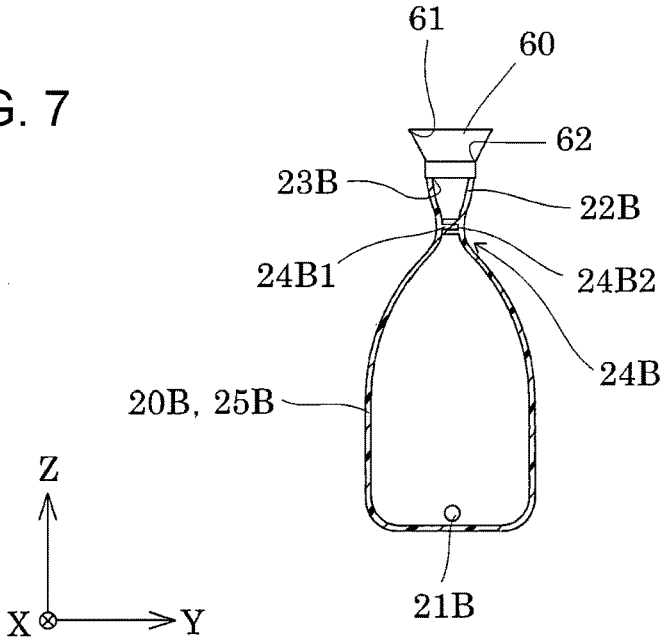
FIG. 7 is a diagram illustrating a schematic configuration of a storage tank of a second embodiment.

FIG. 7 is a front view illustrating a schematic configuration of a storage tank of a second embodiment. As illustrated in FIG. 7, a storage tank 20B has the same configuration as the storage tanks 20*a* to 20*f* of the first embodiment, with the exception of the point that a liquid filling assist member 60 is provided to a liquid filling inlet 23B in order to assist ink refill.

The liquid filling assist member 60 is formed in a funnel shape, and has a first diameter opening 61 that is larger than the liquid filling inlet 23B, and a second diameter opening 62 that is the same size as, or smaller than, the liquid filling inlet 23B. The second diameter opening 62 is connected and fixed to the liquid filling inlet 23B of the storage tank 20B, and the second diameter opening 62 and the first diameter opening 61 are in communication with the liquid filling inlet 23B.

During ink refill, ink is refilled through the first diameter opening 61, enabling easy refilling of the storage tank 20B with ink. Even if ink splashes during ink refill, the ink adheres to an inner wall of the liquid filling assist member 60, thereby enabling contamination of the surroundings of the apparatus to be prevented. Moreover, ink that has adhered to the inner wall of the liquid filling assist member 60 can be removed easily, thereby enabling contaminated ink to be prevented from entering the storage tank 20B the next time ink is refilled.

The storage tank 20B, in which the liquid filling inlet 23B is provided with the liquid filling assist member 60, enables any air that enters the storage tank 20B during ink refill to be removed using a zip-lock mechanism 24B similar to that of the first embodiment. This thereby enables a drop in the de-aeration level of the ink to be suppressed, thereby maintaining a constant de-aeration level, such that there is no need to perform de-aeration of the ink inside the liquid storage section 9 using a de-aeration device or the like. Moreover, even in cases in which the amount of refill ink prepared is small, since any air that enters the storage tank 20B during ink refill can easily be removed, the ink stored in the storage tank 20B does not come into contact with air, enabling a drop in the de-aeration level to be suppressed. Moreover, since ink refill is performed with a check valve (not illustrated in the drawings) in a closed state, the recording apparatus I enables ink to be refilled without interrupting printing.

Note that the material employed for the liquid filling assist member 60 is preferably a rigid material, from the perspective of preventing ink from leaking to the exterior of the storage tank 20B and contaminating the surrounding environment, and also from the perspective of the ease of ink refill. For example, the material used may be the same as the material used for the housing sections 30*a* to 30*f* and the covers 40*a* to 40*f* of the first embodiment.

Other Embodiments

The liquid storage section of the present embodiment is configured with the flexible section that makes the entire liquid storage section flexible, and the liquid storage section is pressed from one side face by the pressing unit. However, the invention is not limited to this configuration. For example, pressing units may be disposed at both side faces of a storage tank, and the storage tank may be pressed from both sides by the two pressing units. Such a configuration enables the speed with which the liquid surface of the ink rises to be increased, improving operation efficiency.

Moreover, the liquid storage section of the present embodiment is configured such that the storage tank is pressed using the pressing unit. However, in the invention, pressing may be performed manually. For example, configuration may be made in which plural housing sections are individually provided in the apparatus main body 1, and one or both side walls of each housing section are removed in a region corresponding to the flexible section of the storage tank, thereby enabling an operator to press the storage tank. This enables manual pressing of the storage tank by the operator, thereby enabling ink to be refilled easily without interrupting printing even in cases in which the amount of refill ink prepared is small.

In the first embodiment described above, explanation has been given in which the liquid ejecting head mounted to the liquid ejecting apparatus is given as an example of a device applying a piezoelectric element. However, the scope of application of the invention is not limited thereto. Moreover, although explanation has been given in which an ink jet recording head is given as an example of a liquid ejecting head, obviously the invention may be applied to liquid ejecting head that ejects a liquid other than ink. Examples of liquid ejecting heads that eject a liquid other than ink include colorant ejecting heads employed in the manufacture of color filters such as liquid crystal displays; electrode material ejecting heads employed in electrode formation in organic EL displays, Field Emission Displays (FED), and the like; and bio-organic material ejecting heads employed in biochip manufacture.

The entire disclosure of Japanese Patent Application No. 2016-248422, filed Dec. 21, 2016 is expressly incorporated by reference herein.

What is claimed is:

1. A liquid ejecting apparatus comprising:

a liquid ejecting head configured to eject a liquid; and a liquid storage section configured to store the liquid to be fed to the liquid ejecting head, the liquid storage section comprising:

a liquid feed port to feed the liquid to the liquid ejecting head, a liquid filling inlet to refill the liquid, the liquid filling inlet being configured for opening and closing, an interlocking mechanism having a male portion that interlocks with a female portion to thereby seal the liquid filling inlet, and a storage tank of which at least part is provided with a flexible section having flexibility, the storage tank having a volume that can be changed by the flexible section deforming.

2. The liquid ejecting apparatus according to claim 1, further comprising a pressing unit that presses the flexible section.

3. The liquid ejecting apparatus according to claim 1, wherein:

the liquid filling inlet is provided with a liquid filling assist member that assists with refilling of the liquid; and the liquid filling assist member is formed in a funnel shape including a first diameter opening larger than the liquid filling inlet and a second diameter opening of the same size as or smaller than the liquid filling inlet.

4. The liquid ejecting apparatus according to claim 1, wherein the liquid storage section includes a rigid housing section, and the storage tank is provided inside the housing section.

* * * * *